United States Patent [19]

Schnell et al.

[11] Patent Number: 4,467,930

[45] Date of Patent: Aug. 28, 1984

[54] OVERMOLDED CLOSURE SEAL

[75] Inventors: William J. Schnell, Wheeling; Thomas A. Fowles, McHenry; Albert Henhapl, Rowling Meadows, all of Ill.

[73] Assignee: Baxter Travenol Laboratories, Inc., Deerfield, Ill.

[21] Appl. No.: 365,941

[22] Filed: Apr. 6, 1982

[51] Int. Cl.[3] ..... B65D 1/02

[52] U.S. Cl. ..... 215/32; 215/252

[58] Field of Search ..... 215/32, 252

[56] References Cited

U.S. PATENT DOCUMENTS

| | | | |
|---|---|---|---|
| 2,347,737 | 5/1944 | Fuller | 18/47.5 |
| 3,140,329 | 7/1964 | Nutting | 264/242 |
| 3,191,655 | 6/1965 | McCord | 152/427 |
| 3,214,504 | 10/1965 | Gemberling | 264/242 |
| 3,260,777 | 7/1966 | Brandt | 264/262 |
| 3,286,010 | 11/1966 | van Groningen | 264/242 |
| 3,597,793 | 8/1971 | Weiler et al. | 18/5 BF |
| 3,699,198 | 10/1972 | Robinson | 264/96 |
| 3,776,996 | 12/1973 | Cameron et al. | 264/242 |
| 3,907,687 | 9/1975 | Hoeltzenbein | 210/321 |
| 3,966,869 | 6/1976 | Kohl | 264/242 |
| 4,021,524 | 5/1977 | Grimsley | 264/242 |
| 4,156,490 | 5/1979 | Peraboni | 215/252 |
| 4,176,755 | 12/1979 | Winchell | 215/32 |
| 4,210,618 | 7/1980 | Piltz et al. | 264/130 |
| 4,254,884 | 3/1981 | Maruyama | 215/232 |

*Primary Examiner*—Donald F. Norton

*Attorney, Agent, or Firm*—Garrettson Ellis; Paul Flattery; Thomas A. Kmiotek

[57] ABSTRACT

Containers used for storing and dispensing liquids for medical applications and formed in a one-piece, molded construction include a neck defining a dispensing outlet and an annular lip, a closure for the outlet and a frangible section coupling the closure to the neck. An article of manufacture and a method are provided where a frangible section couples the closure to the neck and defines an annular channel between the outlet lip and the closure. Completing the article of manufacture and method, the neck has an overmold which engages the closure whereby the molding of the overmold may tend to reduce the bio-burden at the area of contact of the overmold and the neck and whereby displacement of the overmold ruptures the frangible section permitting removal of the overmold and closure for opening of the container.

16 Claims, 4 Drawing Figures

OVERMOLDED CLOSURE SEAL

FIELD OF THE INVENTION

The invention relates generally to containers for storing and dispensing liquids. It particularly relates to a pour bottle for storing and dispensing liquids where the bottle is of one-piece molded construction and in which the bottle closure is coupled to the bottle neck by means of a frangible section. To remove the contents of the bottle, the closure is severed from the neck at the frangible section, and the closure is removed.

BACKGROUND OF THE INVENTION

Containers or bottles, formed in a one-piece, molded construction in which the container closure is coupled to the container neck by means of a frangible section, are known in the art. In order to remove the contents from such a container, the closure is severed from the neck by rupturing the frangible section and removing the closure.

In certain medical applications the containers typically have a tear-away top and the contents of the container typically comprise sterile liquids. U.S. Pat. No. 4,176,755 to Winchell for "Resealable Pour Bottle With Severing Ring," for example, discloses a container including a neck defining a dispensing outlet and a container closure covering the outlet. A frangible section couples the container closure to the neck forming a one-piece, molded construction. An outer rotatable righ encircling the container closure and neck portion is press fitted and then threaded onto the neck, providing protection from inadvertent breaking of the frangible section, and also providing a means of severing the closure from the neck at the frangible section when desired by rotating the ring.

Because of the structure of the neck, closure, and outer ring, the outer edge of the pouring lip of the opened container has generally been nonsterile, resulting in a possible contamination source as liquid pours over the lip.

In addition, press fitting the outer ring over the neck portion covered with a frangible, sealed closure risks rupturing of the frangible section, and is an extra manufacturing step adding to the cost of the process.

By this invention, the outer edge of the pouring lip can be sealed in a sterile manner, while an opening ring or overmold can be formed in a simplified manner on the container neck, to provide an aseptic seal about the neck until opening. By extending the overmold above the container closure, the container closure is protected. Rupture of the frangible seal caused by stacking the containers is greatly diminished because the overmold guards the entire closure.

As an additional feature, a fracturable tamperproof member may be molded over the container neck coincidentally with the overmold; connected to the overmold but located below it. Slight movement of the overmold will fracture the tamperproof member, providing a visual check on the integrity of the frangible seal covered by the overmold.

BRIEF SUMMARY OF THE INVENTION

The present invention overcomes the drawbacks of the prior art by providing an overmolded closure seal for containers and a method of manufacturing such containers. The overmolded closure seal comprises a container including a neck defining a dispensing outlet and a lip, a closure for the outlet, and a frangible section coupling the closure to the neck, with an annular overmold sealing at least a portion of the container neck and engaging the outlet closure.

Typically, the frangible section couples the closure to the neck at a point below the plane of the dispensing outlet, thereby defining a sealed, annular channel between the lip on the neck and the closure.

Before the closure is molded and coupled to the container neck, the container may be filled with sterile liquid by a known process. The container is then immediately capped by the closure, with the closure thereby assuring the sterility of the contents and the sterility of the outer lip edge and annular channel between the lip and the closure.

The neck of the container can have one or more helically inclined edges which carry and axially raise an annular, rotatable overmold as it is rotated. The annular overmold is typically made of plastic that is sealingly incompatable with the container. Accordingly, on rotation of the overmold, the frangible section between the closure and the neck is ruptured, thereby permitting removal of the overmold and closure from the container.

Once the frangible section between the closure and the neck is ruptured and the desired quantity of contents has been used, the container can be reclosed by securing the overmold on the neck for locking-type retention. The helically inclined edges which circumscribe the periphery of the neck may define one or more overlapping portions of edge sections on the neck which define spaced therebetween. These spaces receive projection members defined on the overmold for retention of the overmold on the neck. Thus, reclosing can be accomplished.

The method of this invention provides a sealing system for plastic containers. The method involves blow molding a container defining a neck which has an outlet. After filling the container with liquid, a closure for the container neck is formed and coupled to the neck at an annular frangible section. At this stage, the neck and closure portion of the container are placed in a mold where the neck and closure act as a mold core. A plastic sealingly incompatible with the closure and neck is injected into the mold forming an annular overmold to surround and cover the neck and engage the closure, preferably forming a sterile area therebetween by bacteriocidal action of the plastic.

It is an aim of the present invention to provide a container of one-piece, molded construction for maintaining the seal of the contents of the closed container, while providing sterility if desired to an outer pouring lip edge by including it within the seal, thus eliminating a possible contamination source when the frangible connection is broken and the contents pour over the lip.

Another aim of the present invention is to provide a bacteria-blocking seal to the neck portion of a container, the interior of which seal may be sterile if desired when manufactured.

A further aim of the present invention is to provide an overmolded seal for a container closure, eliminating the need to press-fit an outer ring over the container neck closure. By molding directly about the container neck an annular, rotatable overmold made of a plastic which is sealingly incompatible with the container, the press-fitting of an outer ring over the container closure and cap is eliminated. This greatly reduces the possibility of accidental rupturing of the frangible seal, and eliminates the cost of an added manufacturing step.

Other aims and advantages of this invention will become apparent upon reading the following detailed description and appended claims.

BRIEF DESCRIPTION OF THE DRAWINGS

For a more complete understanding of this invention reference should now be had to the embodiment illustrated in greater detail in the accompanying drawings.

In the drawings.

DESCRIPTION OF THE PREFERRED EMBODIMENTS

Figure 1:
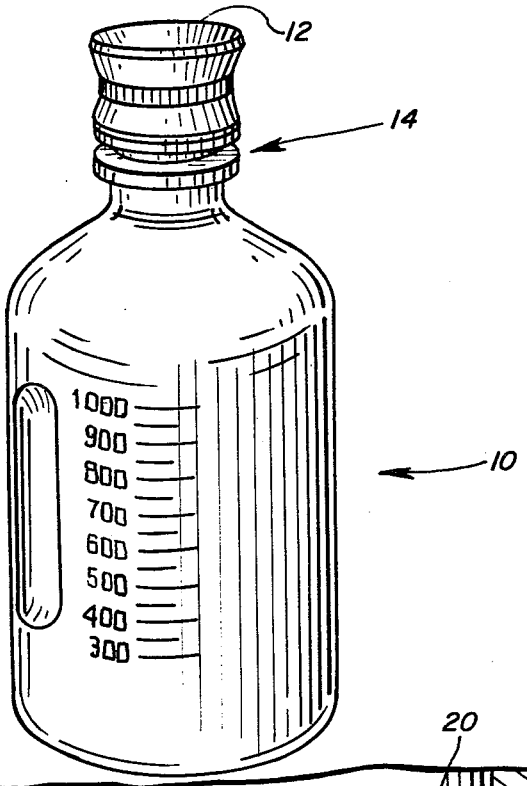
FIG. 1 is a perspective view of a pour bottle with a portion of the neck covered by the annular overmold.
Figure 2:
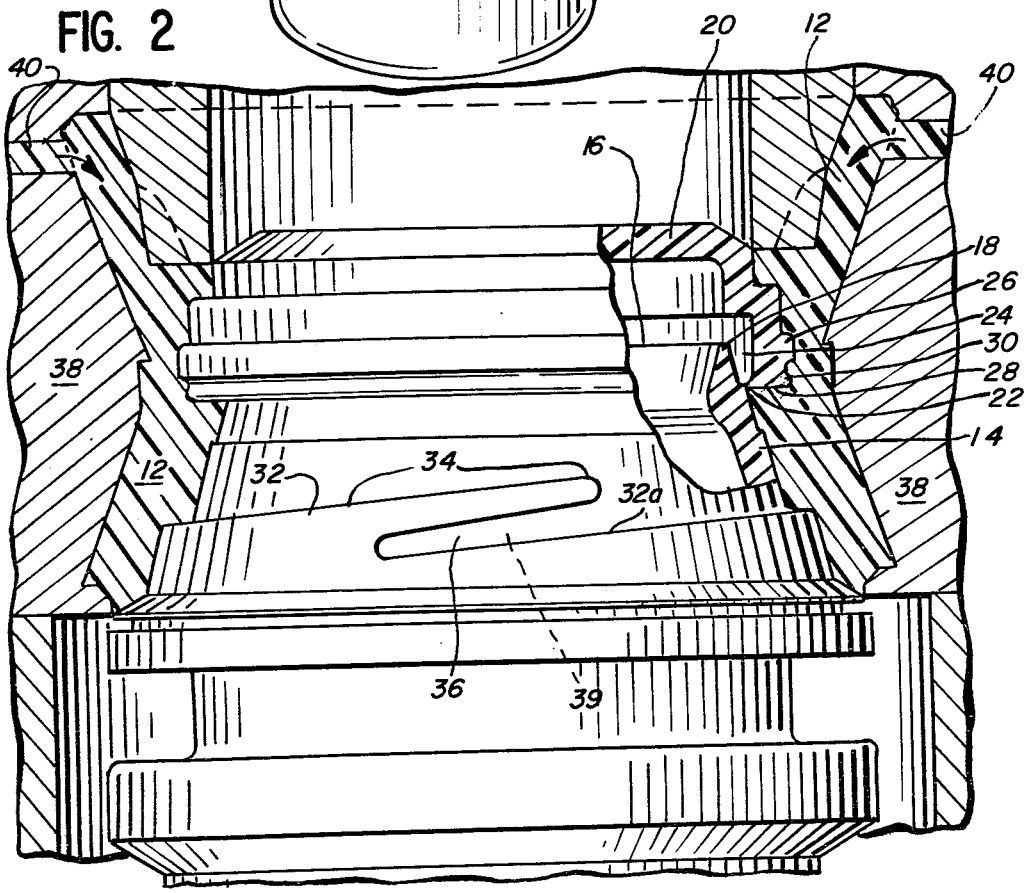
FIG. 2 is an elevational view taken partly in section of the top portion of a container in a mold for forming the annular overmold of this invention.

Turning now to the drawings, FIGS. 1 and 2 show a pour bottle 10, for containing sterile water, sterile saline solution, or the like. Bottle 10 defines neck 14, which carries sealed closure 20 (FIG. 2). Annular overmold 12 surrounds a portion of neck 14.

Referring to FIG. 2, neck 14 defines a dispensing mouth or outlet 16 surrounded by annular pouring lip 18. Closure 20 for the outlet 16 is coupled to neck 14 at frangible section 22. The sealing system of this invention generally includes closure 20 covering outlet 16, with annular overmold 12 surrounding a portion of neck 14 and closure 20.

More specifically, closure 20 covering outlet 16 is coupled to neck 14 at frangible section 22 below the plane of outlet 16. By coupling closure 20 to neck 14 in this manner, an annular channel 24 is defined between annular lip 18 and the inside of the closure 20.

In FIG. 2, closure 20 has a bottom face 28 and an outwardly extending shoulder abutment 26. Closure 20 also has an outwardly projecting bead 30 above bottom face 28. The annular, outwardly extending shoulder abutment 26 and the annular outwardly projecting bead 30 as illustrated in FIGS. 1 and 2 are particularly preferred embodiments. However, the unique features of the sealing system of this invention may also be achieved with one or more spaced, outwardly projecting shoulder abutments or studs and/or a series of spaced outwardly projecting beads which function in a manner similar to annular abutment 26 and annular bead 30.

Figure 3:
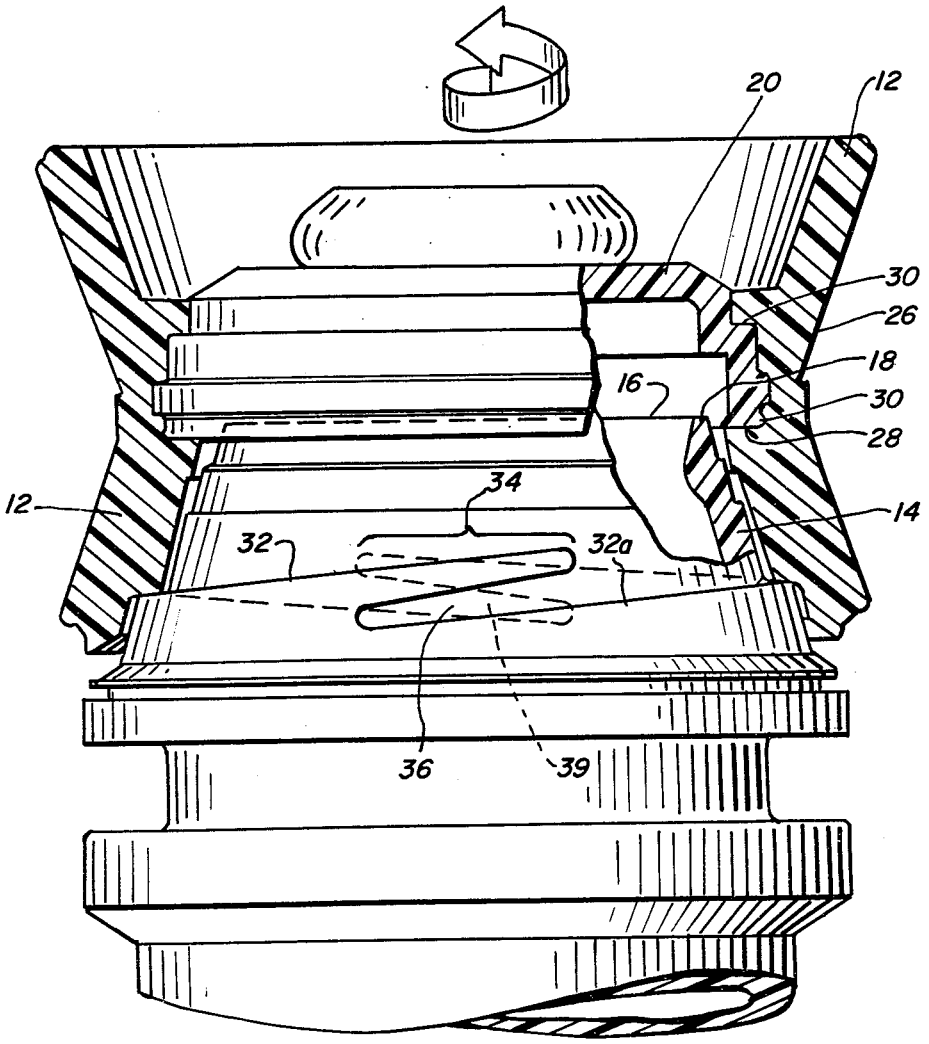
FIG. 3 is an elevational view taken partly in section showing the neck and closure portion of the container as the overmold and closure are being removed.

Container neck 14 also defines a pair of helically inclined edges 32, 32*a* circumscribing the periphery of the neck 14. The helically inclined edges 32, 32*a* together circumscribe the periphery of neck 14 at least one full time (each extending about 190°–250°), preferably defining overlapping portions of edge sections 34, and defining spaces 36 between the overlapping edge sections. Helically inclined edges 32, 32*a* may be circumscribed on a cylindrical section of the neck 14 or on a conical neck section, as specifically shown. Two helically inclined edges 32, 32*a* as illustrated in FIGS. 2 and 3 defining overlapping portions of edge sections 34 are particularly preferred embodiments. However, a single helically inclined edge or a larger plurality of helically inclined edges, with or without overlapping edge portions, may alternatively be circumscribed on the neck.

Various alternative embodiments of sealing systems of this invention include a closure with either an annular shoulder abutment or an outwardly projecting abutment or stud, an annular outwardly projecting bead or a series of outwardly projecting beads, one or more helically inclined edges circumscribing the periphery of a cylindrical or conical neck section, and an annular overmold covering at least a portion of the neck from the inclined edge to engage either the annular outwardly projecing bead or outwardly projecting series of beads or the annular bead or series of beads and the shoulder abutment or stud. Also, helically inclined edge or edges 32, 32*a* may be defined by screw threads, having upper and lower edges rather than the single-edged structure shown in FIG. 2 (except at overlapping section 34).

The sealed container of this invention is constructed by first blow molding, by known technology, a container such as bottle 10 and defining the neck 14 having outlet 16 therein. The container is then filled with water, saline solution, or the like, preferably by a sterile fill technique, followed by the molding of the closure 20 over outlet 16 to seal the container. Sealing the container in this fashion can also insure that the annular channel 24, and hence the outside of pouring lip 18, remain sterile.

Particularly preferred plastics for the container include polypropylene, polyethylene, clear polyethylene terephthalate, and rigid polyvinyl chloride.

Once the container 10 is filled and closed, it is inserted into a mold 38 where a sealingly incompatible molten plastic is injected into the mold 38 through ports 40 to form the overmold 12. Neck 14 and closure 20 act as a mold core in mold 38. The term "sealingly incompatible" implies that the plastic does not adhere significantly to the plastic of the bottle neck, so that when cool it can be rotated relative to the bottle neck.

Annular overmold 12, covers neck 14 from helically inclined edges 32, 32*a* to at least outwardly extending bead 30 on closure 20, which it engages, and it optionally extends beyond to guard and protect closure 20. The molten plastic injected into die 38 is preferably hot enough (for example 250° to 400° F.) to form a bacteria killing and preferably sterile sealed area at the area of contact of overmold 12 and neck 14, and yet is preferably not hot enough to cause major plastic deformation of neck 14 and closure 20. For example, particularly preferred sealingly incompatible plastics for the overmold include polystyrene, ABS, polyvinyl chloride, acetal homopolymers or copolymers, and ultra violet light transmitting polytetrafluoroethylene, when the container plastic is polypropylene or copolymers having a high polypropylene content.

Sealingly incompatible plastics for the overmold may also be impregnated with a germicide or an antibacterial agent that is released by heat during the molding of the overmold, for example chlorinating agents such as chlorinated triazine or chlorinated melamine may be used, or organic peroxides such as benzoyl peroxide or dicumyl peroxide may be used. Also, by using a polyacetal, namely paraformaldehyde, an acetal homopolymer (or formaldehyde enriched acetal homopolymer), for example Delrin® manufactured by E. I. du Pont de Nemours & Co., or an acetal copolymer (or formaldehyde enriched acetal copolymer), for example Celcon® manufactured by Celanese Corporation, formaldehyde is naturally released by heat during the molding of the overmold. Both the heat of the molten plastic and optionally, antibacterial agent such as formaldehyde will aid in forming a sealed area of diminished bio-burden, and preferably sterile, at the area of contact of the overmold and neck.

In addition, use of polyurethane or epoxy resins for the overmold may also tend to reduce the bio-burden at the area of contact of the neck and the overmold, since such materials have a germicidal or anti-bacterial effect.

FIG. 3 shows annular overmold 12 being rotated. Rotation of the overmold 12 causes it to move axially outward, driven along helically inclined edges 32, 32*a*, causing rupture of frangible section 22. This permits removal of overmold 12 and closure 20 from neck 14 of the container. As is shown in this embodiment, overmold 12 engages outwardly extending bead 30 and shoulder abutment 26 by contacting bottom face 28 of the closure 20 and preferably also extending thereabove. Thus, closure 20 can remain permanently engaged to overmold 12. Upon molding of overmold 12, projection member 39 is formed at its inner surface for retention of the overmold 12 on neck 14 in space 36 between the overlapping portions 34 of helically inclined edges 32, 32*a* circumscribing the periphery of neck 14. Projection member 39 withdraws from space 36 as overmold 12 is rotated for opening, and allows a locking-type reclosure of the container by its reinsertion into space 36, as overmold 12 is reapplied to the container neck.

Figure 4:
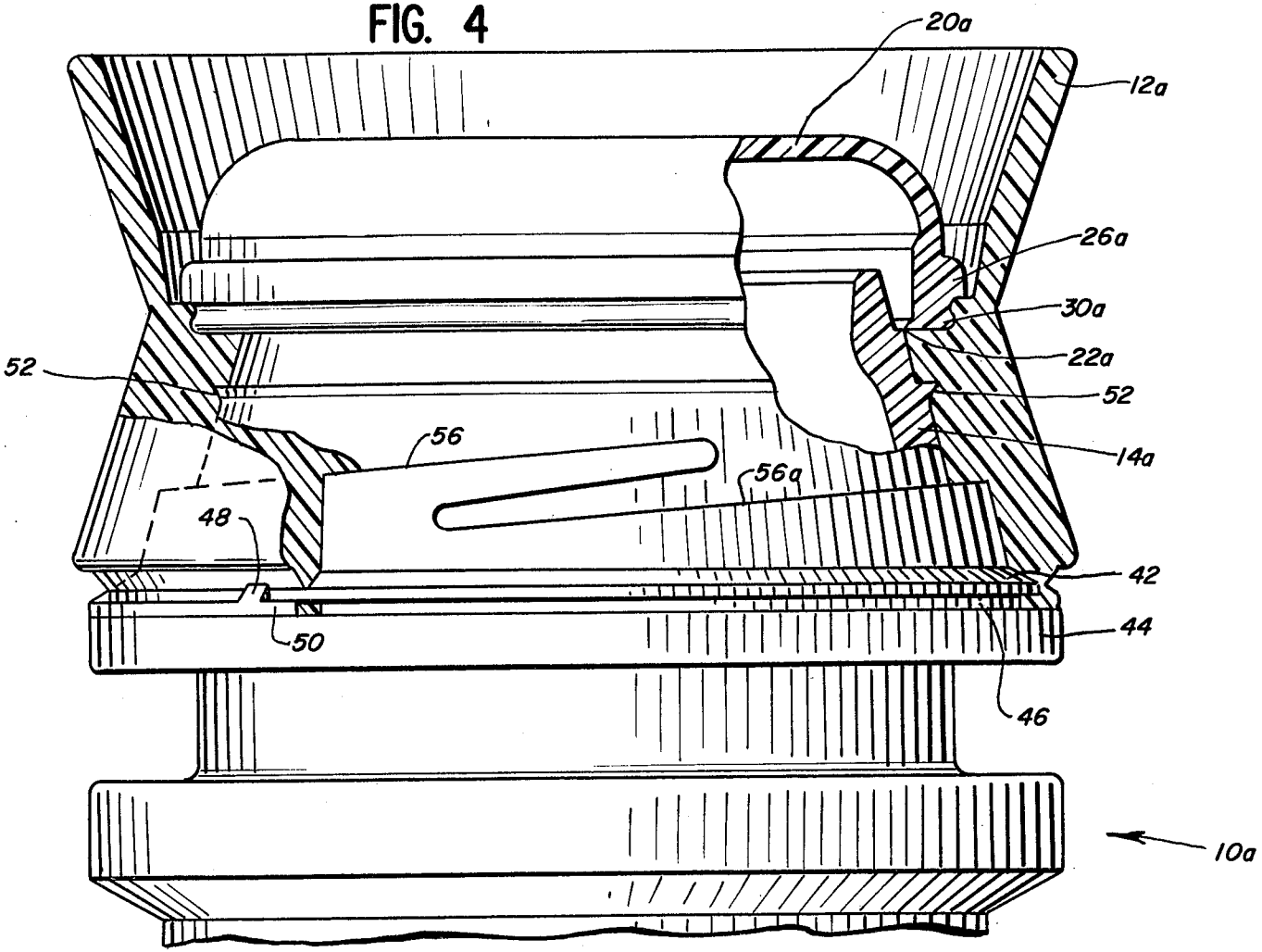
FIG. 4 is an elevational view taken partly in section showing another embodiment of the annular overmold of this invention.

The alternative embodiment shown in FIG. 4 is substantially the same as the embodiment illustrated in FIGS. 2 and 3 except as otherwise described herein. Between first annular flange 42 on the container neck 14*a* and second annular flange 44 is defined an annular groove 46. Fluted recesses 48 in first annular flange 42 function as mold gates in the overmolding process to allow plastic to flow into annular groove 46 when overmold 12 is molded over closure 20*a* and neck 14*a*. Frangible section lands or fingers 48 thus are formed, and the plastic in annular groove 46 together with the plastic of frangible lands 48 form a fracturable tamperproof member 50. Slight rotational or axial displacement of the overmold 12*a* will fracture the tamperproof member 50 at or near frangible lands 48, allowing a visual check on the integrity of the covered closure 20*a* and frangible section 22*a*. That is, if frangible 48 of fracturable, tamperproof member 50 is fractured, there also exists a substantial likelihood that frangible section 22*a* of closure 20*a* has been fractured. Overmold 12*a* is shown engaging closure 20*a* at annular bead 30*a* without also engaging the top of annular shoulder abutment 26*a*. Thus closure 20*a* can be separated from overmold 12*a*.

On neck 14*a*, between helical edges 56 and 56*a* and frangible section 22*a*, this embodiment provides an annular lip portion 52 on neck 14*a*. Lip portion 52 provides a slight overhang to neck 14*a*. When overmold 12*a* is removed from bottle 10*a*, lip portion 52 will deflect radially inwardly and upwardly allowing the overmold 12*a* to slip over the lip portion 52. When reclosing opened bottle 10*a*, lip portion 52 will be engaged by overmold 12*a* forming a seal to control leakage of fluid remaining in bottle 10*a*.

In additional alternative embodiments, the annular shoulder abutment 26*a* on closure 20*a* may be replaced by an outwardly projecting abutment or stud fidedly engaged by overmold 12*a*. Since rotation of the overmold 12*a* fixedly engaging a projecting abutment or stud would cause torsional shear eventually rupturing the frangible section 22*a*, tension on the frangible section 22*a* and consequently axial displacement are not necessary to assure rupture. The helically inclined edges 50, 56*a* circumscribing the periphery of neck 14*a*, would, therefore, necessarily not be needed to axially raise the overmold, although its presence is preferred.

The above has been offered for illustrative purposes, and is not intended to limit the invention of this application, which is defined in the claims below.

What is claimed is:

1. A sealing system for a container used for storing and dispensing liquids, said container including a neck defining a dispensing outlet surrounded by an annular lip, a closure for said outlet, and a frangible section coupling said closure to said neck, the improvement comprising, in combination:

said closure defining an outwardly extending bead;

said frangible section coupling said closure to said neck at a point below the plane of said dispensing outlet, to define an annular channel between said lip and said closure;

said neck having an annular overmold, said overmold having an inner surface in intimate, space-free contact with the outer surface of the closure and neck, said overmold covering said neck and said bead and engaging said bead on said closure, whereby displacement of said overmold causes rupture of said frangible section permitting removal of said overmold and said closure from said neck.

2. The sealing system of claim 1 wherein said container is a plastic, sterile-filled bottle and wherein said annular overmold forms a bacteria blocking seal around the outside of the said neck.

3. The sealing system of claim 1 wherein said container including said neck, closure and frangible section are formed in a one-piece, molded construction.

4. The sealing system of claim 1 wherein said bead is annular.

5. The sealing system of claim 1 wherein said neck has helically inclined edge means and wherein said annular overmold is rotatable, said helically inclined edge means carrying and axially raising said annular rotatable overmold upon rotation thereof, said overmold covering said neck from at least said helically inclined edge means to said bead on said closure, whereby rotation of said overmold causes rupture of said frangible section, permitting removal of said overmold and said closure from said neck.

6. The sealing system of claim 1 wherein said overmold is made of plastic which is sealingly incompatible with said container.

7. The sealing system of claim 1 wherein said overmold, has a fracturable, tamperproof member, whereby slight movement of said overmold will fracture said tamperproof member.

8. A sealing system for a plastic, sterile-filled bottle used for storing and dispensing sterile liquids, said bottle formed in a one-piece, molded construction and including a neck defining a dispensing outlet surrounded by an annular lip, a closure covering said outlet, and a frangible section coupling said closure to said neck, the improvement comprising, in combination:

said closure defining an outwardly extending bead and an outwardly extending shoulder abutment;

said frangible section coupling said closure to said neck at a point below the plane of said dispensing outlet, to define an annular channel between said lip and said closure;

said neck having helically inclined edge means for carrying and axially raising an annular rotatable overmold upon rotation thereof, said overmold covering said neck from at least said helically inclined edge means to said shoulder abutment and engaging said bead and said shoulder abutment on said closure, said overmold being plastic sealingly incompatible with said plastic, sterile-filled bottle and wherein said overmold forms a bacteria blocking seal around the outside of said neck, whereby rotation of said overmold causes rupture of said frangible section permitting removal of said overmold and said closure from said neck.

9. The sealing system of claim 8 wherein said bead and shoulder abutment are annular.

10. The sealing system of claim 8 wherein said overmold has a fracturable, tamperproof member, whereby slight movement of said overmold will fracture said tamperproof member.

11. The sealing system of claims 5, 8, 9 or 10 wherein said helically inclined edge means for carrying and axially raising said overmold circumscribes the periphery of said neck at least one time.

12. The sealing system of claims 5, 8, 9 or 10 wherein said helically inclined edge means for carrying and axially raising said overmold is defined on said neck by an end of a conical section to present said helically inclined edge means to said overmold, to facilitate separation of said overmold from the annular conical surface as said overmold is axially moved upon rotation, said inclined edge means circumscribing the periphery of said neck at least one time.

13. The sealing system of claim 12 wherein said helically inclined edge means comprise a pair of helical edges.

14. A sealing system for a container used for storing and dispensing liquids, said container including a neck defining a dispensing outlet and a lip, a closure for said outlet, and a frangible section coupling said closure to said neck, the improvement comprising:

said neck having helically inclined edge means for carrying and axially raising an annular rotatable overmold, said helically inclined edge means circumscribing the periphery of said neck more than one time, and defining an overlapping portion of edge sections on said neck defining a space therebetween, said space receiving a projection member defined on said overmold for retention of said overmold on said neck, said closure defining an outwardly extending bead having an underside for engaging an upwardly facing surface of said overmold to enable fracture of said frangible section upon raising said overmold.

15. The sealing system of claim 14 wherein said helically inclined edge means for carrying and axially raising said overmold upon rotation thereof is defined on said neck by an end of a conical section to present said helically inclined edge means to said overmold, to facilitate separation of said overmold from the annular conical surface as said overmold is axially moved upon rotation, whereby rotation of said overmold causes rupture of said frangible section permitting removal of said overmold and closure from said neck.

16. The sealing system of claims 5, 8, 14 or 15 wherein said neck, between said frangible section and said helically inclined edge means, defines an annular lip defining an overhang, whereby on reclosing said container, said overmold will engage said lip forming a seal to prevent leakage of the liquid contents remaining therein.

* * * * *